US007581338B1

(12) United States Patent
Housley, Jr. et al.

(10) Patent No.: US 7,581,338 B1
(45) Date of Patent: Sep. 1, 2009

(54) BOOT MOUNTED SHIFTING AND BREAKING DEVICE

(76) Inventors: Norman A. Housley, Jr., 231 West, San Antonio, TX (US) 78124; Janine A Calvert, 604 Jamie Sue Dr., Converse, TX (US) 78109

( * ) Notice: Subject to any disclaimer, the term of this patent is extended or adjusted under 35 U.S.C. 154(b) by 556 days.

(21) Appl. No.: 11/530,677

(22) Filed: Sep. 11, 2006

(51) Int. Cl.
*A43B 13/22* (2006.01)

(52) U.S. Cl. ..... 36/131; 36/136

(58) Field of Classification Search ..... 36/131, 36/113, 132, 136
See application file for complete search history.

(56) References Cited

U.S. PATENT DOCUMENTS 3,812,606 A * 5/1974 Merola ..... 36/72 R
4,513,561 A 4/1985 Welton et al.
5,168,644 A 12/1992 Ellis
D362,928 S 10/1995 Redden
5,855,078 A * 1/1999 Starker ..... 36/72 R
6,385,865 B1 * 5/2002 Jang et al. ..... 36/61
2001/0011430 A1 * 8/2001 Davis et al. ..... 36/138
2001/0013216 A1 8/2001 Balkenhol
2002/0108357 A1 8/2002 Martin
2003/0226287 A1 12/2003 Borne

* cited by examiner

*Primary Examiner*—Marie Patterson
(74) *Attorney, Agent, or Firm*—Advantia Law Group; Michael W. Starkweather; Jason P. Webb

(57) ABSTRACT

A boot mounted breaking and shifting device for motorcycles. An embodiment of the present invention includes: three V-shaped members, six arm members; two support members; a U-shaped member; a flexible chevron plug removably inserted into a chevron hole formed between the U-shaped member and one of the V-shaped members; and a flexible strap removably coupleable to four of the six arm members via a plurality of buttons.

6 Claims, 2 Drawing Sheets

BOOT MOUNTED SHIFTING AND BREAKING DEVICE

BACKGROUND OF THE INVENTION

1. Field of the Invention

The present invention relates to devices for wearing on a boot, specifically a boot mounted shifting and breaking device for motorcycles.

2. Description of the Related Art

In the related art, it has been known to attach spur devices to boots when riding to control the movement and direction of horses. Spurs are either permanently secured to the rider's boot or are removably attached to the rider's boots. These spurs have rigid protrusions which do not give way when they contact another object. Spurs are worn by a rider who sits on a horse's back with his or her legs straddled on either side of the horse and the spurs extend from the rear of a person's boots. However, there is a need for a spur device which will provide users with greater stability and control when riding. It is also desired to provide a spur which can be worn on a user's boot even if the boot does not provide a groove between the boot's upper and outer sole. Some improvements have been made in the field. Examples include but are not limited to the references described below, which references are incorporated by reference herein:

U.S. Pat. No. 4,513,561, issued to Welton et al., discloses a spur holder is formed of flexible material and has a rear body and sides connecting the body to a front loop, which is stretchable over the heel of the boot to engage the front of the heel, with the rear body disposed at the rear of the boot adjacent the upper edge of the heel. The rear body has a generally oval front edge and a rear edge corresponding generally to a portion of an ellipse, while each of the front and rear edges of the loop corresponds generally to a flattened oval. A rib extends inwardly from the rear body and a portion of each of the sides, adjacent the inner edge of each and is adapted to engage a crevice above the heel when the holder is installed on a boot. A spur rowel and shank are attached to the rear body, as by a plate molded within the rear body or a cap which covers the plate and is vulcanized to the rear body. The inner edge of each of the sides may be provided with a taper opposite the rib to accommodate additional stretching of these edges. A spur is produced by molding an outwardly extending, integral button on the rear body, while an alternative molded spur has a downwardly bowed front loop which includes a downward offset connecting it with each side and the front of the rear body is concave and slopes downwardly and forwardly. The rear body and a major part of each side have an inwardly extending, downwardly sloping rib for engagement with the crevice between the heel and the counterheel. The shank may be molded integrally with the rear body and have a vertical slot across which a pin extends to rotatably support a rowel.

U.S. Pat. No. 5,168,644, issued to Ellis, discloses A wear protection device is provided for protecting the instep portion of a motorcycle boot from wear which would otherwise result from contact with the gear shift lever of a motorcycle. Wear protection device includes a flexible shield member having a truncated elliptical contour and a releasable coupling engaged within the arched portion of the sole of boot. In a preferred embodiment, the releasable coupling includes a single strap member threaded through a pair of slotted through openings disposed on opposing ends of shield member. Strap member is formed of an elastic material having hook-and-loop fastening elements disposed on opposing ends of strap member, respectively.

U.S. Patent Application Publication No.: 2001/0013216, by Balkenhol, discloses a strap-attached spur which is configured substantially U-shaped and has two lateral bars. Two spur strap eyelets are provided for in each free end of each bar and receive a spur strap of the strap attachment. The two spur strap eyelets of either end are not parallel but form an acute angle between each other.

U.S. Patent Application Publication No.: 2002/0108357, by Martin, discloses an ergonomic spur which is designed for engagement with a riding boot. The spur can be removably attached to the riding boot with out damaging the boot. The arch brace of the spur of the present invention provides two planes of contact between the spur and the riding boot. The spur is formed in a manner which allows for sufficient rigidity without covering a large portion of the boot's surface area.

U.S. Patent Application Publication No.: 2003/0226287, by Borne, discloses a boot includes a heel with a rear side having embedded therein one component of a two-component coupling member. A detachable spur has a distal end with a barb element thereat and a proximal end with a second component of the two-component coupling member. The second component is detachably connected to the one component, with the distal end projecting outward from the heel to position the barb element for use while riding.

U.S. Design Pat. No. D362,928, issued to Redden, discloses the ornamental design for a spur.

The inventions heretofore known suffer from a number of disadvantages which include being inefficient, impractical for manipulating motorcycle controls; and/or impractical for braking motorcycles.

What is needed is a device for wearing on a boot that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available devices for wearing on a boot. Accordingly, the present invention has been developed to provide a boot mounted shifting and breaking device for motorcycles.

In one embodiment of the present invention, there is a boot mounted shifting and breaking device for motorcycles. The boot mounted breaking and shifting device may include: a first V-shaped member that may have a first vertex, and/or may have a first arm member that maybe coupled to the first vertex and/or may extend outwardly therefrom, and/or may have a second arm member that may be coupled to the first vertex and/or may extend outwardly therefrom.

In another embodiment of the present invention, the boot mounted breaking and shifting device may also include: a second V-shaped member that may have a second vertex, and/or may have a third arm member, that may be coupled to the second vertex and/or may extend outwardly therefrom, and/or may have a fourth arm member that may be coupled to the second vertex and/or may extend outwardly therefrom, wherein the third arm member may be coupled to the first arm member at an end opposite the first vertex, and/or may extend outwardly therefrom; and/or the fourth arm member may be coupled to the third arm member at an end opposite the first arm member, and/or may extend upwardly therefrom.

In yet another embodiment of the present invention, the boot mounted breaking and shifting device may further include: a third V-shaped member that may have a third vertex, and/or may have a fifth arm member that may be coupled to the third vertex and/or may extend outwardly therefrom, and/or may have a sixth arm member that may be coupled to the third vertex and extending outwardly therefrom, wherein: the fifth arm member may be coupled to the second arm member at an end opposite the first vertex, and may extend outwardly therefrom, and may be substantially parallel to the third arm member; and the sixth arm member that may be coupled to the fifth arm member at an end opposite the second arm member, and/or may extend upwardly therefrom, and may be substantially parallel to the fourth arm member.

In still yet another embodiment, the boot mounted breaking and shifting device may further include: a third V-shaped member having: a first support member that may be coupled to the second vertex, and/or may extending inwardly therefrom, and may be substantially orthogonal to the third arm member; a second support member that may be coupled to the third vertex, and/or extend inwardly therefrom, and may be substantially orthogonal to the fifth arm member; a U-shaped member that may be coupled to the first and/or second arm members, respectively, and/or may extend upwardly therefrom, and may be substantially toward the first vertex, and may thereby create chevron hole between the U-shaped member and/or the V-shaped member; and a strap that may be removably coupled to the third and/or fourth arm members, respectively, at an end opposite the second vertex, and/or may be removably coupled to the fifth and/or sixth arm members, respectively, at an end opposite the third vertex.

In still yet a further embodiment, the boot mounted breaking and shifting device may include: a flexible chevron plug that may be removably inserted into the chevron hole; and/or a strap that may be removably coupled by buttoning.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
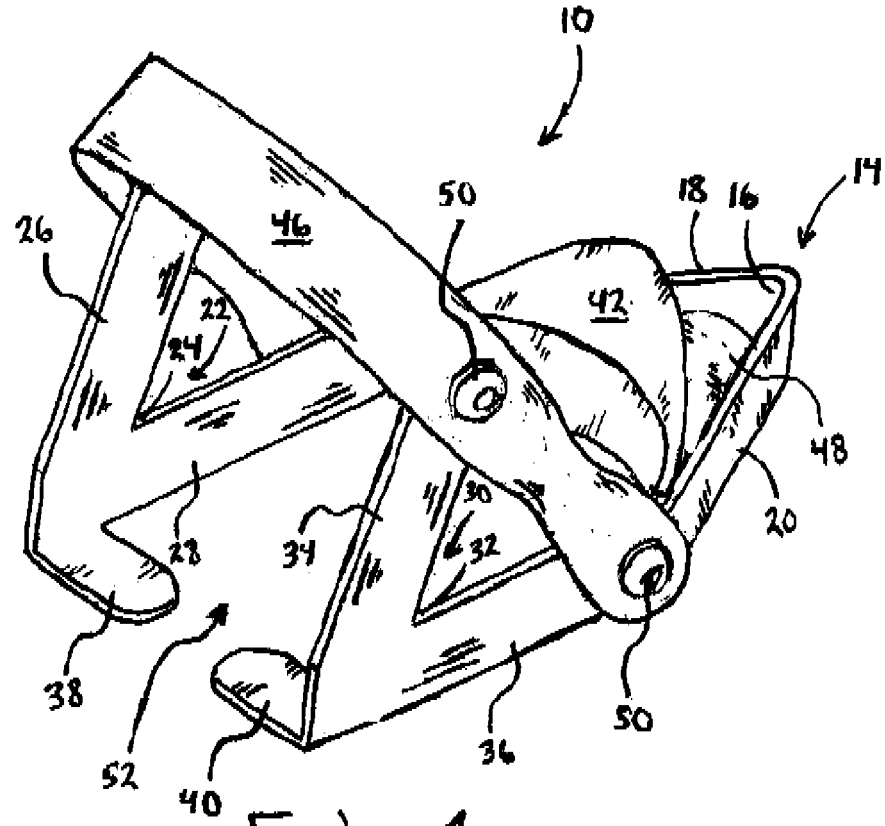
FIG. 1 is a front perspective view of a boot mounted breaking and shifting device, according to one embodiment.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Looking to the figures, there is one embodiment of a boot mounted breaking and shifting device 10 configured for a user to wear on his or her boot 12 while shifting and breaking a motorcycle. The illustrated boot mounted breaking and shifting device includes: a first V-shaped member 14 having: a first vertex 16; and a first arm member 20 and second arm member 18, each coupled to, and extends outwardly from the first vertex 16; a second V-shaped member 30 having: a second vertex 32; and a third arm member 36 and fourth arm member 34, each coupled to, and extends outwardly from the second vertex 32. The third arm member 36, as shown, is coupled to, and extends outwardly from the first arm member 20 at an end opposite vertex 16. In addition, the fourth arm member 34 is coupled to, and extends upwardly from third arm member 36 at an end opposite first arm member 20.

The illustrated embodiment of the boot mounted breaking and shifting device 10 further includes: a third V-shaped member 22 having: a third vertex 24; and a fifth arm member 28 and sixth arm member 26 each coupled to, and extends outwardly from the third vertex 24. The fifth arm member 28 is coupled to, and extends outwardly from second arm member 18 at an end opposite the first vertex 16, and is substantially parallel to third arm member 36. Likewise, the sixth arm member 26 is coupled to, and extends outwardly from fifth arm member 28 at an end opposite second arm member 18, and is substantially parallel to fourth arm member 34.

The illustrated embodiment of the boot mounted breaking and shifting device 10 further includes: a third V-shaped member 30 having: a first support member 40 coupled to, and extends inwardly from second vertex 32, and is substantially orthogonal to third arm member 36; a second support member 38 coupled to, and extends inwardly from third vertex 24, and is substantially orthogonal to fifth arm member 28; a U-shaped member 42 coupled to, and extends upwardly from arm members 18, 20, and is positioned substantially toward the first vertex 16, thereby creating a triangular chevron hole 44 between U-shaped member 42 and V-shaped member 14, and configured to receive a flexible chevron plug 48. There is also a flexible strap 46 removably coupleable to arm members 34, 36, respectively, at an end opposite the second vertex 32. The strap 46 is also removably coupleable to arm members 26, 28, respectively, at an end opposite the third vertex 24. The strap 46 is removably coupleable to arm members 26, 28, 34, 36 via buttons 50.

In operation of the embodiment, a user can insert his or her boots 12 into a 3-point hook up area 52 with heels 54 touching the U-shaped member 42 and the bottom of the soles 56 near the end of the boot 12 opposite the heels 54 touching the support members 38, 40. In this position the V-shaped member 14 is extended rearward from the boot heels 54. The user then could then place the strap 46 over the top of the boot 12 and removably couple such to arm members 26, 28, 34, 36 via buttons 50. The support members 38, 40 help stabilize the user's boots 12 in the boot mounted breaking and shifting device 10. When a user is operating a motorcycle, motorbike, etc. with touring bars/highway pegs (motorcycles designed without forward controls) and is required to shift gears and/or brake to halt the motorcycle, the user could place his or boots 12 on the touring bar on both sides of the motorcycle, and pivot his or feet backward until the V-shaped member 14 is engaged with a braking mechanism positioned to the rear of the touring bar on side of the motorcycle and a shifting mechanism positioned to the rear of the touring bar on the other side of the motorcycle.

The embodiment of the boot mounted breaking and shifting device 10 enables the user to manipulate the motorcycle's shifting and braking mechanisms by lowering and/or raising his or her heels 54 while leaving his or her legs extended forward to the touring bars. This keeps the user's feet and legs in position on both sides of the motorcycle, thereby preventing any imbalance from occurring while riding the motorcycle. In this case, the user would not need to installs expensive forward controls on his or her motorcycle. Non-limiting examples of a motorcycle utilizing touring bars include: a Harley-Davidson FLSTF Fat Boy, Harley-Davidson FXD, and Harley-Davidson FXWD, Harley-Davidson Owners Group, P.O. Box 453, Milwaukee, Wis. 53201.

In another embodiment of the present invention, the boot mounted breaking and shifting device 10 may include a triangular chevron plug 48, wherein the user may removably insert the plug 48 into the bottom rear of V-shaped member 14. The plug may project rearward from the upper heel area of an attractive and comfortable boot 12, thereby serving as a single motorcycle riding boot to be worn only when operating motorcycles.

In yet another embodiment of the present invention, the boot mounted breaking and shifting device 10 may be fixably coupled to a boot 12 and include a triangular shifting mechanism having a nut on its underside. The mechanism may be removably inserted into V-shaped member 14, enabling non-slip braking and/or shifting of the motorcycle.

The boot mounted breaking and shifting device 10 provides safety, comfort, and convenience for motorcycle riders. Instead of repeatedly lifting the left leg and foot to mid-range controls to shift, and using the right leg and foot for braking while operating the motorcycle with touring bar, the rider could easily shift and/or brake using the boot mounted breaking and shifting device 10. The boot mounted breaking and shifting device 10 simplifies shifting and braking of motorcycles without expensive forward controls installed, thereby enabling the rider to remain in a comfortable state for a relaxing ride instead of being inconvenienced with repeated foot movement.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Figure 2:
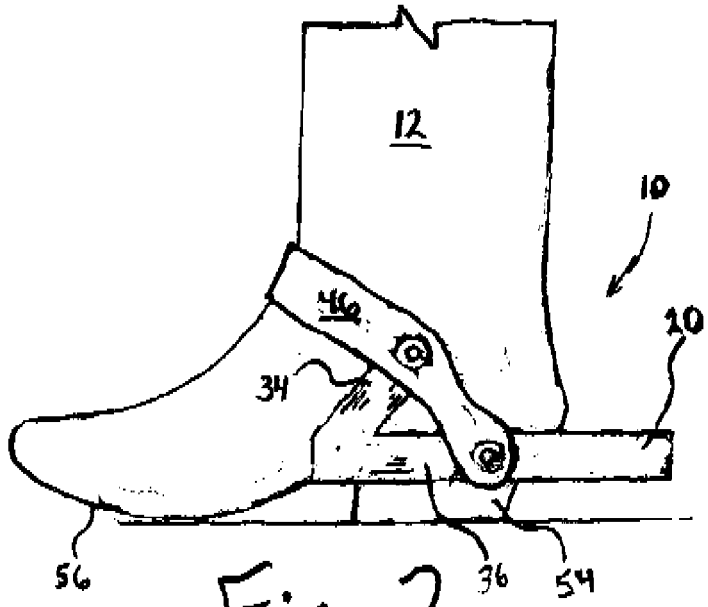
FIG. 2 is a front elevational view of a boot mounted breaking and shifting device coupled to a boot, according to one embodiment.

Although FIG. 2 illustrates a boot mounted breaking and shifting device 10 coupled to a left boot 12, anyone skilled in the art would know that the boot mounted breaking and shifting device can be manufactured to be coupled to a right boot.

Figure 3:
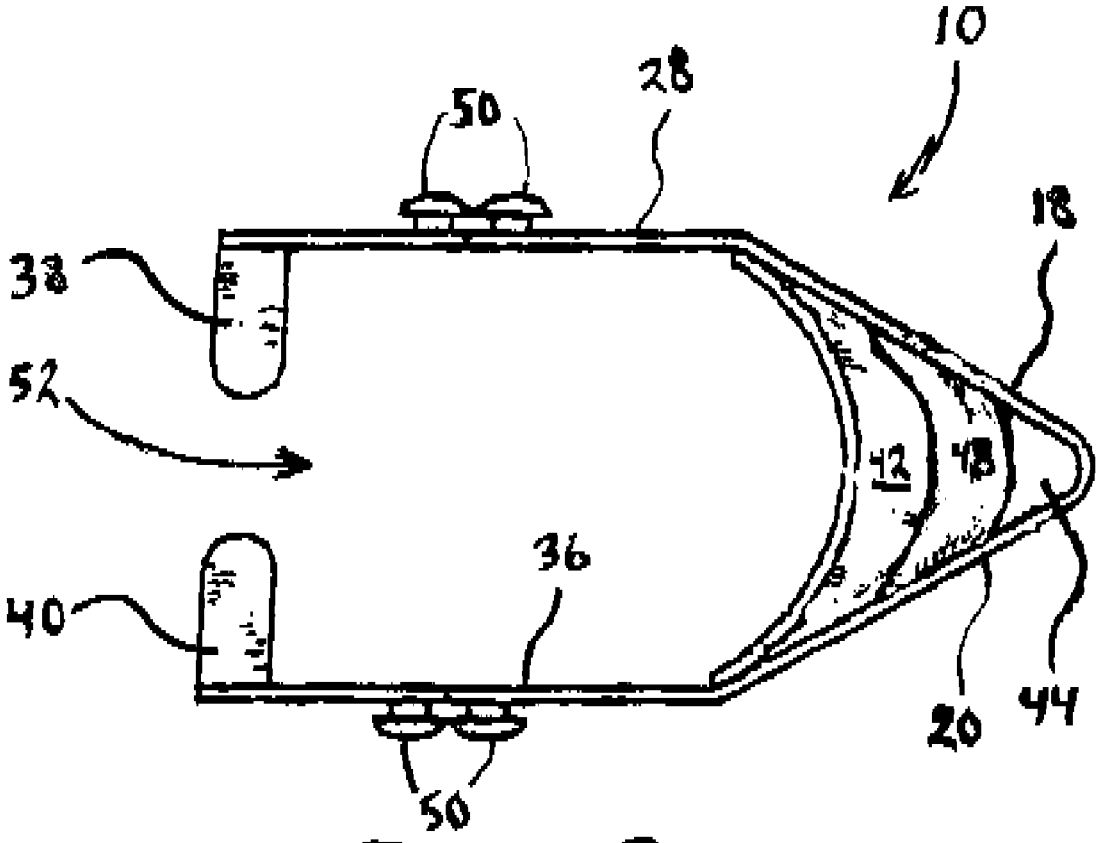
FIG. 3 is a top plan view of a boot mounted breaking and shifting device, according to one embodiment.

Additionally, although FIG. 3 illustrates the chevron hole 44 being triangular in shape, one skilled in the art would know that the hole can be form of various shapes such as square, rectangular, arc-shaped, etc.

It is also envisioned that the flexible strap 46 could be constructed of various non-metallic materials. For example, plastic, leather, rubber, etc.

It is expected that there could be numerous variations of the design of this invention. An example is that the V-shaped members 14, 22, 30; vertices 16, 24, 32; arm members 18, 20, 26, 28, 34, 36; support members 38, 40; U-shaped member 42; chevron hole 44; and/or strap 46 may be designed in various lengths, widths, etc. such that the boot mounted breaking and shifting device 10 can be removably coupled to different boot sizes.

Finally, it is envisioned that the components of the device may be constructed of a variety of materials. For example, steel, metal, metal alloys, etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A boot mounted breaking and shifting device for motorcycles, comprising:

a) a first V-shaped member, having a first vertex, having a first arm member coupled to the first vertex and extending outwardly therefrom, and having a second arm member coupled to the first vertex and extending outwardly therefrom;

b) a second V-shaped member, having a second vertex, having a third arm member, coupled to the second vertex and extending outwardly therefrom, and having a fourth arm member coupled to the second vertex and extending outwardly therefrom, wherein:

b1) the third arm member is coupled to the first arm member at an end opposite the first vertex, and extends outwardly therefrom; and b2) the fourth arm member is coupled to the third arm member at an end opposite the first arm member, and extends upwardly therefrom;

c) a third V-shaped member, having a third vertex, having a fifth arm member coupled to the third vertex and extending outwardly therefrom, and having a sixth arm member coupled to the third vertex and extending outwardly therefrom, wherein:

c1) the fifth arm member is coupled to the second arm member at an end opposite the first vertex, and extends outwardly therefrom, substantially parallel to the third arm member; and c2) the sixth arm member is coupled to the fifth arm member at an end opposite the second arm member, and extends upwardly therefrom, substantially parallel to the fourth arm member;

d) a first support member, coupled to the second vertex, and extending inwardly therefrom, substantially orthogonal to the third arm member;

e) a second support member, coupled to the third vertex, and extending inwardly therefrom, substantially orthogonal to the fifth arm member;

f) a U-shaped member, coupled to the first and second arm members, respectively, and extending upwardly therefrom, substantially toward the first vertex, thereby creating a chevron hole between the U-shaped member and the V-shaped member; and g) a strap, removably coupled to the third and fourth arm members, respectively, at an end opposite the second vertex, and removably coupled to the fifth and sixth arm members, respectively, at an end opposite the third vertex.

2. The boot mounted breaking and shifting device of claim 1, further comprising:

a) a chevron plug, removably inserted into the chevron hole.

3. The boot mounted breaking and shifting device of claim 2, wherein the chevron plug is flexible.

4. The boot mounted breaking and shifting device of claim 3, wherein the strap is removably coupled by buttoning.

5. A boot mounted breaking and shifting device for motorcycles, consisting essentially of:

a) a first V-shaped member, having a first vertex, having a first arm member coupled to the first vertex and extending outwardly therefrom, and having a second arm member coupled to the first vertex and extending outwardly therefrom;

b) a second V-shaped member, having a second vertex, having a third arm member, coupled to the second vertex and extending outwardly therefrom, and having a fourth arm member coupled to the second vertex and extending outwardly therefrom, wherein:

b1) the third arm member is coupled to the first arm member at an end opposite the first vertex, and extends outwardly therefrom; and b2) the fourth arm member is coupled to the third arm member at an end opposite the first arm member, and extends upwardly therefrom;

c) a third V-shaped member, having a third vertex, having a fifth arm member coupled to the third vertex and extending outwardly therefrom, and having a sixth arm member coupled to the third vertex and extending outwardly therefrom, wherein:

c1) the fifth arm member is coupled to the second arm member at an end opposite the first vertex, and extends outwardly therefrom, substantially parallel to the third arm member; and c2) the sixth arm member is coupled to the fifth arm member at an end opposite the second arm member, and extends upwardly therefrom, substantially parallel to the fourth arm member;

d) a first support member, coupled to the second vertex, and extending inwardly therefrom, substantially orthogonal to the third arm member;

e) a second support member, coupled to the third vertex, and extending inwardly therefrom, substantially orthogonal to the fifth arm member;

f) a U-shaped member, coupled to the first and second arm members, respectively, and extending upwardly therefrom, substantially toward the first vertex, thereby creating a chevron hole between the U-shaped member and the V-shaped member; and g) a strap, removably coupled to the third and fourth arm members, respectively, at an end opposite the second vertex, and removably coupled to the fifth and sixth arm members, respectively, at an end opposite the third vertex.

6. The boot mounted breaking and shifting device of claim 5, wherein the strap is removably coupled by buttoning.

* * * * *